United States Patent [19]

Rehrig

[11] Patent Number: 4,619,371

[45] Date of Patent: Oct. 28, 1986

[54] THREE-SIDED, STACKABLE MATERIAL HANDLING CRATE

[76] Inventor: James B. Rehrig, 6533 Via Lorenzo, Palos Verdes Peninsula, Calif. 90274

[21] Appl. No.: 609,649

[22] Filed: May 14, 1984

[51] Int. Cl.[4] ..... B65D 6/34

[52] U.S. Cl. ..... 220/71; 206/427; 220/73

[58] Field of Search ..... 220/71, 73; 206/427

[56] References Cited

U.S. PATENT DOCUMENTS

| | | | |
|---|---|---|---|
| 2,502,781 | 4/1950 | Erickson | 220/73 |
| 2,676,729 | 4/1954 | Neville | 220/73 |
| 3,327,896 | 6/1967 | Asenbauer | 220/71 |
| 3,361,292 | 1/1968 | Huisman | 220/97 |
| 3,419,182 | 12/1968 | Gildart | 220/73 |
| 3,997,055 | 12/1976 | Box | 206/427 |
| 3,997,074 | 12/1976 | Shead | 220/71 |

FOREIGN PATENT DOCUMENTS

| | | | |
|---|---|---|---|
| 2437835 | 2/1975 | Fed. Rep. of Germany | 220/71 |
| 2909137 | 9/1979 | Fed. Rep. of Germany | 220/71 |

*Primary Examiner*—George E. Lowrance

*Attorney, Agent, or Firm*—Banner, Birch, McKie & Beckett

[57] ABSTRACT

A three-sided, open top material handling crate, which includes a first reinforcing member extending around the open top of the crate and a second reinforcing member extending at least partly around and closely engaging the periphery of each of the side walls to provide a crate which is able to withstand considerable vertical stacking pressures.

12 Claims, 7 Drawing Figures

THREE-SIDED, STACKABLE MATERIAL HANDLING CRATE

BACKGROUND OF THE INVENTION

This invention relates to crates. More particularly, the invention relates to reinforced stackable crates molded from synthetic resin materials and having an open top and an opening in the front wall which provides product visibility and facilitates product removal.

The use of material handling crates formed from synthetic resin materials, hereinafter referred to as plastic, is currently expanding very rapidly, particularly in the dairy industry as milk crates. Injection molded plastic milk crates have many advantages over the conventional wire frame or wooden milk crates, and are rapidly replacing these prior art milk crates in many geographical areas. Among the advantages of the plastic crates is their light weight, the ease with which they may be cleaned, and their neat and attractive appearance, which is not materially altered with age. This expanded use has been, in part, made possible by the practice or reinforcing the crates adjacent the open top portion by metal rings or bars. This practice has been particularly useful in heavy-duty crates or tote boxes such as those employed in the dairy industry or as field crates for vegetables or the like. Numerous arrangements have been devised for reinforcing the top portions of such crates, and one such arrangement is illustrated in commonly assigned U.S. Pat. No. 3,419,182.

Plastic crates of the general type as described in the above-cited patent present many problems with respect to satisfactory stacking not encountered in the conventional wire frame or wooden crates. In order to overcome the stacking problem, previous patents, such as commonly assigned U.S. Pat. No. 3,361,292, have provided reinforcing rings to improve the stackability of a conventional four-sided milk crate.

It has become highly desirable to use a stackable crate which has three sides, rather than four, to eliminate the need for shelving, enhance product display, and facilitate product removal. Stackable molded plastic milk crates are known which have dispensing openings formed in at least one side wall, e.g., U.S. Pat. Nos. 3,997,055 and 3,997,074. Crates of this type have afforded the merchant great convenience in displaying and dispensing products, such as milk in containers, to the consumer. These crates may be suitably stacked for retail display on an open floor to provide additional shelf space in a retail establishment, and the milk containers may be removed by the purchaser directly through the opening without having to remove empty crates from the top of the stack. This enables the merchant to utilize his fixed shelving for other goods, and to avoid having to remove the individual containers from the crates and stack them on other shelves. However, a serious disadvantage in known crates of this type is that the cross-beams which extend along the upper margin of the crate often bend or twist when the crate is heavily loaded. The stack may therefore be rendered unstable and may even overturn if more than a few crates are stacked on one another. Thus, such known designs cannot efficiently be used for warehouse stacking where it is necessary to store palletized crates on the order of ten to fifteen crates high. None of the prior designs provides a stackable three-sided crate which maximizes product visibility, allows for easy consumer removal of the product, yet provides sufficient stacking strength to stack pelletized shipments of crates for warehouse storage.

SUMMARY OF THE INVENTION

The present invention provides an improved reinforced molded, plastic, three-sided material handling crate. The crate has a bottom wall and upstanding front, back, and two, facing side walls. The crate is formed with an open top opposite the bottom wall. The top is defined by the upper edges of the two facing side walls, the front wall, and the back wall. An opening is formed through a substantial portion of the surface of the front wall through which material in the crate can be easily removed. Means are provided for reinforcing the crate to provide improved stackability and material handling strength. The reinforcing means includes a first channel extending around the periphery of the crate adjacent the open top and a first reinforcing member, preferably a metal rod, fitting within the first channel. A second channel is provided extending at least partly around and closely engaging the periphery of each of the side walls. A second reinforcing member, again preferably a metal rod, fits within the second channel. In a preferred form the second channel is U-shaped, with the open end of the U-shaped channel adjacent the open top of the crate. The second channel is connected to the first channel, so that the second reinforcing member can be integrally connected, such as by welding, to the first reinforcing member to provide a supporting framework for the plastic crate which provides superior stacking and carrying strength heretofore not available with prior designs.

The reinforcing members may further include locking means, such as a plurality of tabs integrally formed on and projecting from the reinforcing members and fitting within a corresponding opening formed in the first and second channels.

BRIEF DESCRIPTION OF THE DRAWINGS

Th novel features of the invention are set out with particularity in the appended claims, but the invention will be understood more fully and clearly from the following detail description of a preferred embodiment of the invention as set forth in the accompanying drawings.

DETAILED DESCRIPTION OF A PREFERRED EMBODIMENT

Figure 1:
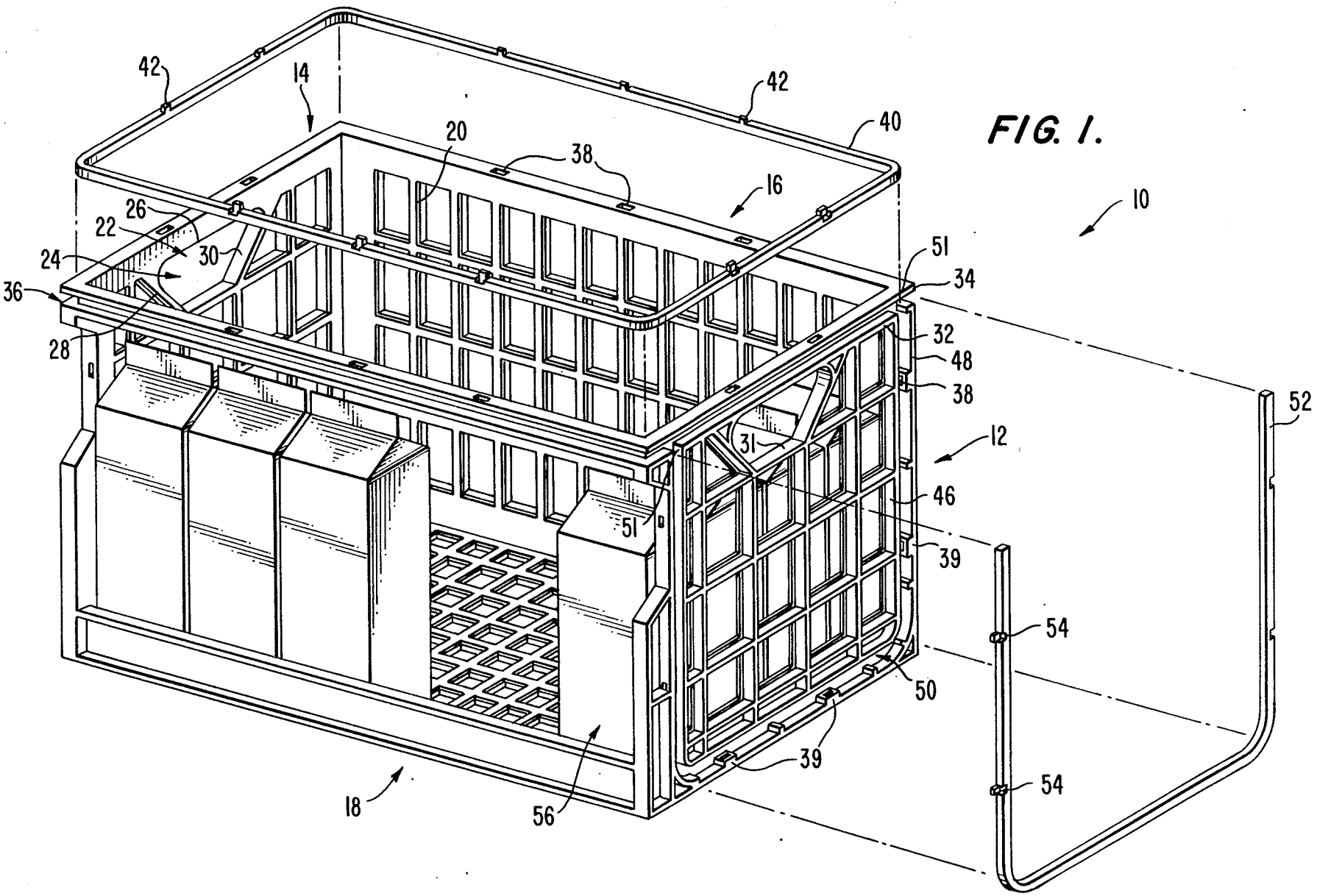
FIG. 1 is a perspective view of the material handling crate according to the invention.

Referring now to the drawings in detail, a reinforced plastic milk crate according to the present invention is indicated generally by the reference numeral 10, and is shown having two integrally molded, vertically extending side wall 12 and 14, a back wall 16, and a front wall 18. The walls may be formed as an open lattice with a plurality of reinforcing, or stiffening ribs 20, as desired, and a hand-hold 22 may be formed in the respective side walls. As shown in FIG. 1, crate 10 is formed with an open top, shown generally at 24.

Figure 5:
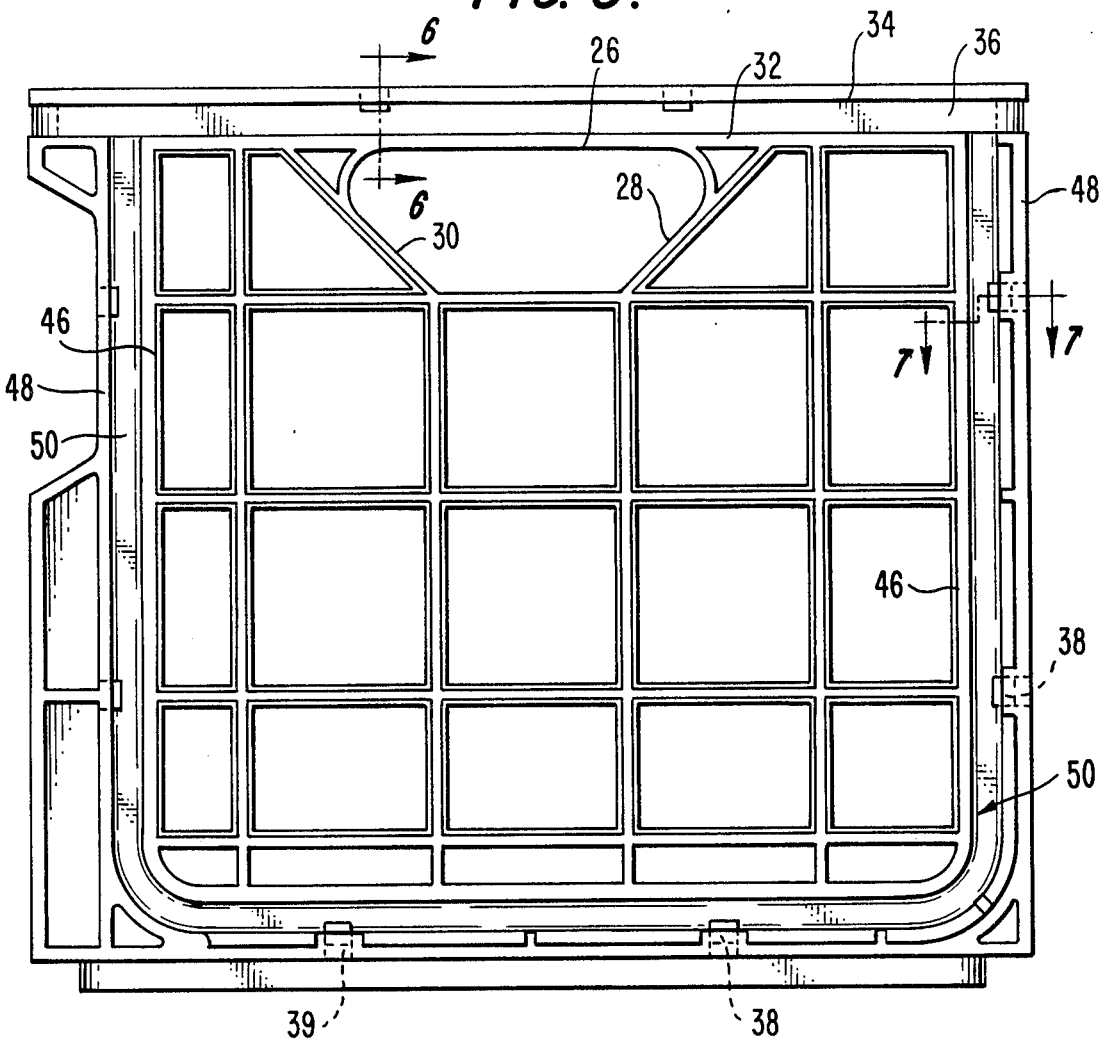
FIG. 5 is a side view of the crate shown in FIG. 1.

To facilitate handling of milk crates of this general type, hand-hold 22 is preferably an elongated, laterally extending, hand-hold adjacent the top edge of each of the side panels 12, 14 of crate 10. Hand-hold 22 is generally triangular in shape, as illustrated in FIGS. 1 and 5, with one side 26 of the triangle extending substantially parallel to and spaced below the open top 24, and with the remaining two sides 28, 30 extending downwardly and inwardly to intersect at a point spaced a substantial distance from the top of a crate and located along the vertical center plane of the crate. Alternatively, as shown in the drawings, sides 28 and 30 may converge at a flat side 31 parallel to side 26, thus forming a somewhat truncated triangle.

Milk crate 10 includes a first channel and reinforcing member extending around and closely engaging the periphery of crate 10 adjacent open top 24. This channel and reinforcing member are similar in construction to that disclosed in commonly assigned U.S. Pat. No. 3,419,182.

As illustrated in FIG. 1, the horizontal cross-section of the crate is substantially rectangular. A pair of vertically spaced, integrally formed flanges 32 and 34 are formed around the outer periphery of crate 10, forming an outwardly directed C-shaped channel 36 around the periphery of the crate adjacent open top 24. A plurality of generally rectangular openings 38 extend vertically through uppermost flange 34 at spaced intervals therealong. At least one, and preferably two or more, of the openings 38 are positioned intermediate the vertical side edges of each of the respective side, back, and front panels. These openings preferably have a built up shoulder portion 39 to provide additional strength.

A reinforcing rod member 40 is formed from preferably a length of steel rod shaped into a generally rectangular confirguation and fits within channel 36. The inner periphery of the rod member 40 is substantially equal to and is shaped to conform to the outer periphery of crate 10 within channel 36. A plurality of tabs 42 are integrally formed on and project upwardly from the upper portion of rod 40. Preferably tabs 42 are formed by coining a portion of the material from the upper portion of the steel rod member 40. The coined tabs 42 have a generally rectangular cross-section correspnding generally to the rectangular shape and size of the openings 38 in flange 34.

Figure 2:
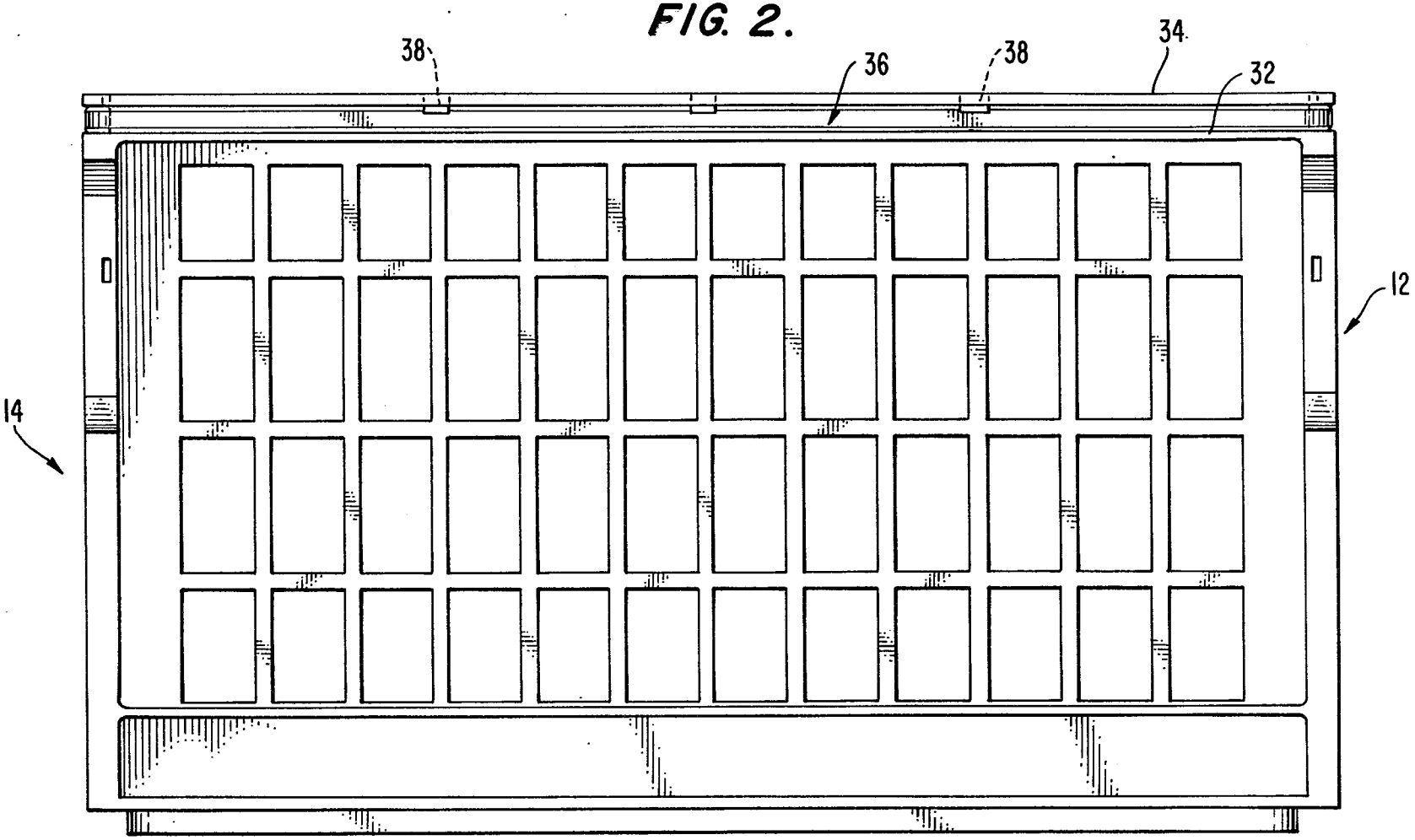
FIG. 2 is a front view of the crate shown in FIG. 1.
Figure 3:
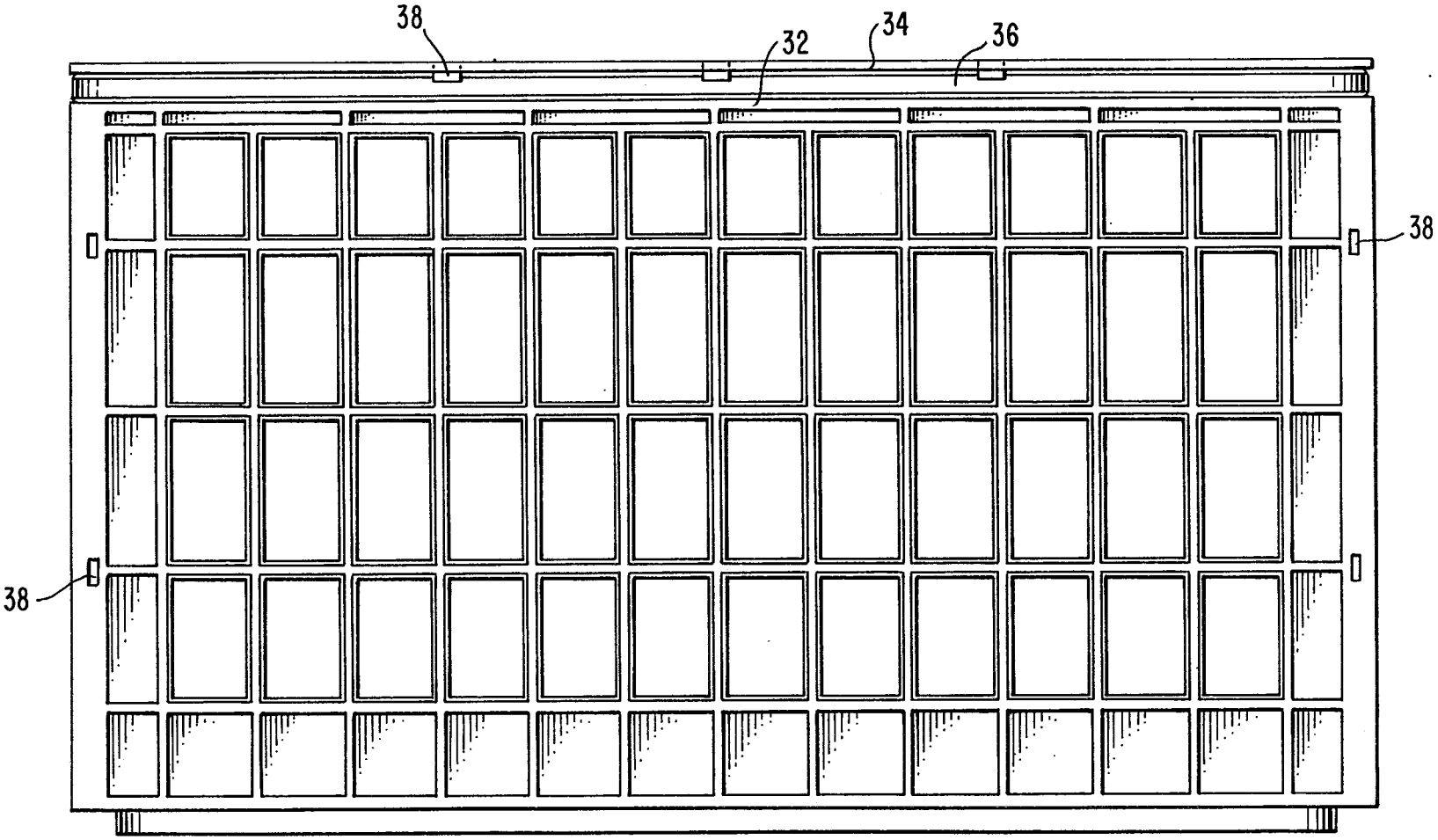
FIG. 3 is a rear view of the crate shown in FIG. 1.
Figure 4:
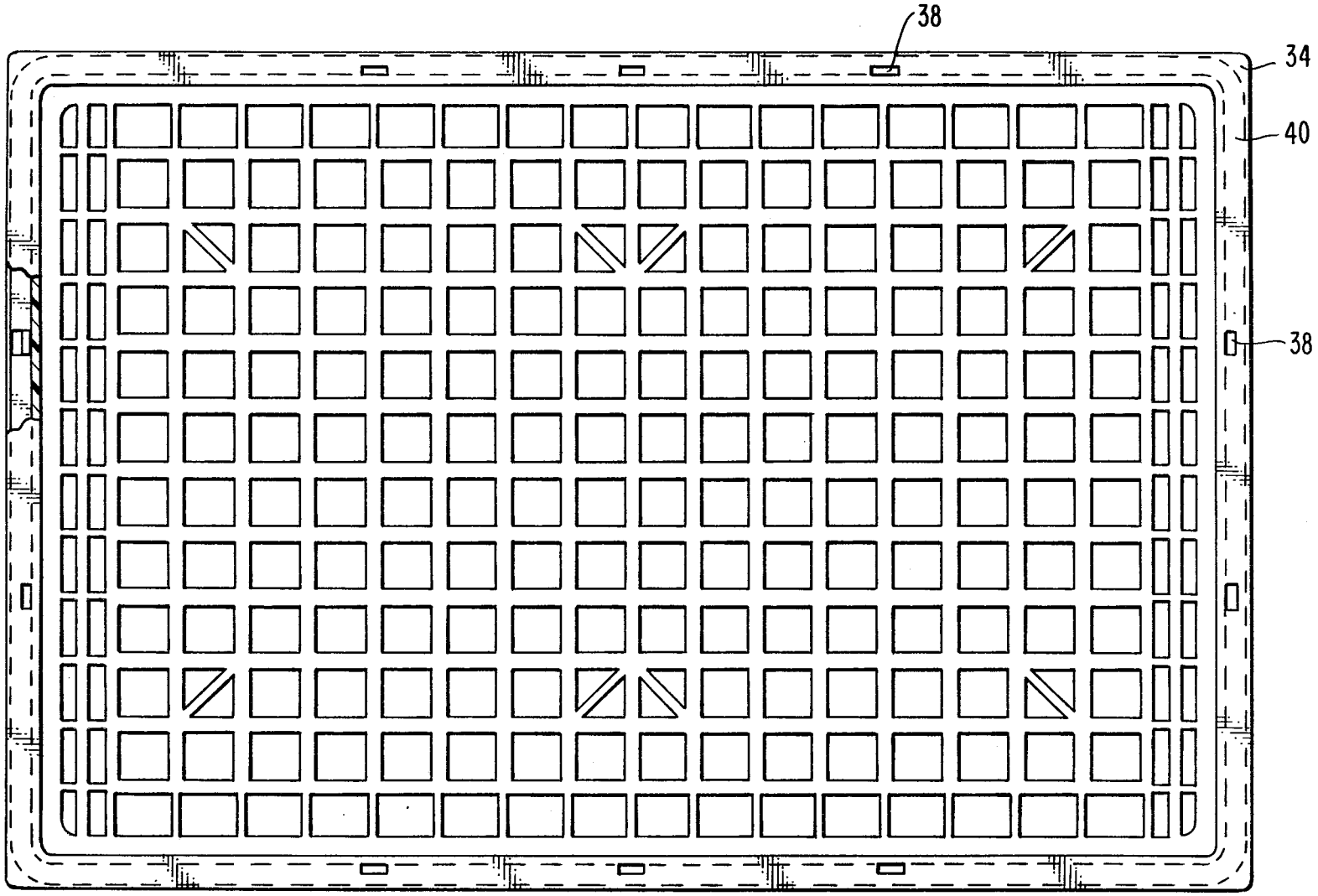
FIG. 4 is a top view of the crate shown in FIG. 1.
Figure 6:
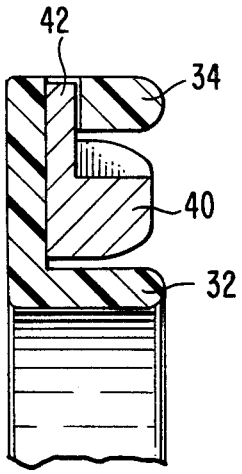
FIG. 6 is a partial sectional view taken along line 6—6 of FIG. 5.

The steel reinforcing rod member 40 is installed on crate 10 within channel 36 with the tabs 42 projecting upwardly into the openings 38 as illustrated in FIGS. 2 and 6. Also, as seen in FIG. 6, the vertical spacing of flanges 32 and 34 is less than the combined vertical dimension of the rod member 40 and tabs 42 so that, once the rod member is installed on the crate, the tabs 42 projecting into openings 38 of flange 34 firmly interlock the top portion of the crate to reinforcing rod 40.

A second channel and reinforcing member is provided extending at least partly around and closely engaging the periphery of each of sidwalls 12 and 14. For convenience only one such channel and reinforcing member will be described. It will be appreciated, however, that each of sides 12 and 14 have an identical second channel and reinforcing member, as described below.

The second channel is similar in construction to the previously described first channel. As shown in FIG. 1 and 5, the second, channel is preferably U-shaped, with the open end of the U-shaped channel adjacent the open top 24 of crate 10. A pair of U-shaped spaced, integrally formed flanges 46 and 48 are formed around the outer periphery of each of side walls 12 and 14, forming an outwardly directed C-shaped channel 50. As shown in FIGS. 1 and 5, the top-most portions of channel 50 has open portions 51 which connect second channel 50 to first channel 36. A plurality of generally rectangular openings 38 extend through the outermost flange 48 at spaced intervals therealong. At least one, and preferably two or more, of the openings 38 are positioned intermediate the side edges of each of the respective walls.

A second reinforcing rod member 52 is formed preferably from a length of steel rod shaped into a generally U-shaped configuration conforming to the shape of channel 50. Rod 52 connects to rod 40 at open portions 51 of channel 50 and preferably rod 52 is there welded or otherwise integrally attached to rod 40. Thus, reinforcing rods 40 and 52 cooperate to provide superior stacking and loading strength. The inner periphery of rod member 52 is substantially equal to and shaped to conform to the outer periphery of crate 10 within channel 50. A plurality of tabs 54 are integrally formed on, and project outwardly from, the outer portion of rod 52. Tabs 54 are substantially identical to previously described tabs 42.

Figure 7:
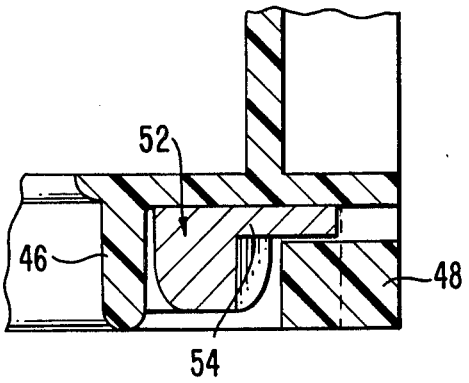
FIG. 7 is a partial sectional view taken along line 7—7 of FIG. 5.

Reinforcing rod member 52 is installed on crate 10 within channel 50 with the tabs 54 outwardly into the openings 38 as illustrated in FIG. 7. Also, as seen in FIG. 7, the horizontal spacing of flanges 46 and 48 is less than the combined horizontal dimension of the rod member 52 and tabs 54 so that, once the rod member is installed on the crate, the tabs 54 projecting into openings 38 of flange 48 firmly interlock crate 10 to reinforcing rod 52.

The molded plastic portion of the crate and the steel reinforcing rod members 40, 52 are separately formed and subsequently assembled. However, since the inner periphery of reinforcing rod members 40 and 52 is less than the outer periphery of flanges 34 and 48, and further since the spacing of the flanges is less than the height of the reinforcing rods and the tabs, it is necessary to deform the molded plastic portion of the crate to assemble the reinforcing rods and the crate. Preferably this is accomplished soon after the molded plastic portion is removed from the injection mold, and while the plastic material is still sufficiently pliable to permit deflection without causing permanent distortion. The plastic is then allowed to cool and harden to form a firmly interlocked assembly.

Front wall 18 is provided with an opening 56, which occupies a substantial portion of the surface area of front wall 18 and enables material, such as milk cartons, to be removed from the crate even when a plurality of crates are stacked upon one another.

The present invention provides a plastic crate of superior strength and stackability. Crates constructed according to the invention may be stacked, for example, 15 crates high, such as on 3 pallets of 5 crates high each. This superior stacking strength allow crates according to the invention to be used both for commercial warehouse storage and then, because of the open front design, to be used directly for retail display.

Although the present invention has been described in terms of a preferred embodiment, it will be obvious to one of ordinary skill that numerous modifications may be made without departing from the true spirit and scope of the invention which is to be limited only by the following claims.

I claim:

1. In a stackable material handling crate having a bottom wall, and an upstanding front wall, back wall, and side walls fixed to said bottom wall, said crate botton wall and said side walls being integrally formed molded plastic panels, an open top opposite said bottom wall defined by the upper edges of said side walls, front wall and back wall, an opening in said front wall through which material in the crate can be removed, and means reinforcing said crate, the improvement wherein said reinforcing means comprises:

a first circumferential channel extending around the periphery of said crate adjacent said open top said first channel having a substantially U-shaped cross-section defined by a top wall, a back wall, and a bottom wall so that the open side of said first channel faces outwardly, one of said first channel walls having first retaining means for retaining a first reinforcing member therein;

a first circumferential reinforcing member extending around and closely engaging the periphery of said crate adjacent said open top, said first reinforcing member fitting within said first channel and retained within said first channel by said first retaining means;

a second substantially U-shaped channel having a substantially U-shaped cross-section extending around and closely engaging the periphery of each of opposite walls of the crate, said U-shaped second channel opening upwardly and extending through the bottom wall of said first channel so that said second channel connects with said first channel at a connecting position, said second channel having a second retaining means for retaining a second reinforcing member therein; and a second substantially U-shaped reinforcing member fitting within and coextensive with said second channel and retained within said second channel by said second retaining means, said second reinforcing member being integrally connected to said first reinforcing member, at said connecting position where said second channel connects with said first channel.

2. A material handling crate as recited in claim 1 wherein said first and second reinforcing member are metal rods welded together.

3. A material handling crate as recited in claim 1 further comprising locking means integrally formed on said first and second reinforcing members to engage and penetrate a wall of said first and second channels, respectively.

4. A material handling crate as recited in claim 3 wherein said locking means comprises a plurality of tabs integrally formed on and projecting from each of said reinforcing members, each of said tabs projecting into a corresponding opening formed in said first and second channels.

5. A material handling crate as recited in claim 1 wherein said second reinforcing member and said second channel are U-shaped.

6. A material handling crate as recited in claim 5 wherein said second channel is open to and connects with said first channel so that said first and second reinforcing member can be integrally connected to said first reinforcing member.

7. A one piece, stackable, molded plastic material handling crate comprising:

a bottom wall, a front wall, a back wall, two facing side walls, and an open top opposite said bottom wall defined by the upper edges of said side walls, said back wall and said front wall, said front wall having an opening occupying a substantial portion of the surface area of said front wall;

a first circumferential channel extending around the periphery of said crate adjacent said open top said first channel having a substantially U-shaped cross-section defined by a top wall, a back wall, and a bottom wall so that the open side of said first channel faces outwardly, one of said first channel walls having first retaining means for retaining a first reinforcing member therein and a first circumferential reinforcing member extending around the periphery of said crate and retained within said first channel by said first retaining means; and a second substantially U-shaped channel having a substantially U-shaped cross-section extending around the periphery of each of said facing side walls said U-shaped second channel opening upwardly and extending through the bottom wall of said first channel so that said second channel connects with said first channel at a connecting position, said second channel having second retaining means for retaining a second reinforcing member therein and a second substantially U-shaped reinforcing member coextensive with and retained within said second channel by said second reinforcing member.

8. A material handling crate as recited in claim 7 further comprising locking means integrally formed on said first and second reinforcing members to engage and penetrate a wall of said first and second channels, respectively.

9. A material handling crate as recited in claim 8 wherein said locking means comprises a plurality of tabs integrally formed on and projecting from each of said reinforcing members, each of said tabs projecting into a corresponding opening formed in said first and second channels.

10. A material handling crate as recited in claim 9 wherein said second reinforcing member and said second channel are U-shaped.

11. A material handling crate as recited in claim 12 wherein said second channel is open to and connects with said first channel, and wherein said first and second reinforcing member are integrally joined at the point where said channels connect.

12. A material handling crate as recited in claim 11 wherein said first and second reinforcing members are metal rods and are welded together.

* * * * *